US006600826B1

(12) United States Patent
Xavier

(10) Patent No.: US 6,600,826 B1
(45) Date of Patent: Jul. 29, 2003

(54) MODULARLY EXPANDIBLE, MULTI-USER AUDIO HEADPHONE

(76) Inventor: Elius A. Xavier, 1257 Elder Ave., Bronx, NY (US) 10472

( * ) Notice: Subject to any disclaimer, the term of this patent is extended or adjusted under 35 U.S.C. 154(b) by 0 days.

(21) Appl. No.: 09/899,965

(22) Filed: Jul. 6, 2001

(51) Int. Cl.[7] ..... H04R 25/00

(52) U.S. Cl. ..... 381/384; 381/370; 381/378; 439/638

(58) Field of Search ..... 381/370, 374, 381/384, 377–379, 380–383; 439/668, 669, 638

(56) References Cited

U.S. PATENT DOCUMENTS

| | | | | | |
|---|---|---|---|---|---|
| 3,586,977 | A | | 6/1971 | Lustig | |
| 4,097,111 | A | | 6/1978 | Martin | |
| 4,367,001 | A | * | 1/1983 | Munakata | 439/175 |
| 4,803,728 | A | * | 2/1989 | Lueken | 439/638 |
| 4,829,571 | A | * | 5/1989 | Kakiuchi et al. | 381/309 |
| 5,146,619 | A | | 9/1992 | Brown | |
| D338,010 | S | | 8/1993 | Yamatogi | |
| 5,326,283 | A | * | 7/1994 | Chen | 439/622 |
| 5,419,707 | A | * | 5/1995 | Kelley | 439/21 |
| 5,794,127 | A | | 8/1998 | Lansang | |
| 5,812,683 | A | | 9/1998 | Parker et al. | |

* cited by examiner

*Primary Examiner*—Rexford Barnie
*Assistant Examiner*—P. Dabney

(57) ABSTRACT

An audio headphone is disclosed having a pair of earpiece speakers affixed to an adjustable leaf spring such as to allow the headphone to affix to a user's head in such a manner as to align the speakers with the user's ears. The speakers are in electrical communication with a stereo, CD player, MP-3 player, or the like by a communication cable that terminates in a modular interconnection housing. The modular interconnection housing has a male communication connector protruding from one end, and a female communication connector received at the opposite end. The male communication connector is designed to provide electrical communication with the audio signal, and the female communication connector is designed to provide parallel electrical communication with the male communication connector.

5 Claims, 2 Drawing Sheets

MODULARLY EXPANDIBLE, MULTI-USER AUDIO HEADPHONE

BACKGROUND OF THE INVENTION

1. Field of the Invention

The present invention relates to audio headphones and more particularly pertains to a new modularly expandible, multi-user audio headphone for allowing a plurality of users to acquire the same audio output signal from a single audio output means.

2. Description of the Prior Art

The use of audio headphones is known in the prior art. More specifically, audio headphones heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,812,683; U.S. Pat. No. 4,097,111; U.S. Pat. No. 3,586,977; U.S. Pat. No. 5,146,619; U.S. Pat. No. 5,794,127; and U.S. Pat. No. Des. 338,010.

While these devices fulfill their respective, particular objectives and requirements, the aforementioned patents do not disclose a new modularly expandible, multi-user audio headphone. The inventive device includes the ability of a plurality of users to acquire the same audio output signal from a single audio output means.

In these respects, the modularly expandible, multi-user audio headphone according to the present invention substantially departs from the conventional concepts and designs of the prior art, and in so doing provides an apparatus primarily developed allows a plurality of users to acquire the same audio output signal from a single audio output means in such a manner as to allow each individual user to control the volume and balance of his or her individually acquired audio signal.

SUMMARY OF THE INVENTION

In view of the foregoing disadvantages inherent in the known types of audio headphones now present in the prior art, the present invention provides a new modularly expandible, multi-user audio headphone construction wherein the same can be utilized for multiple users.

The general modularly expandable, multi-user audio headphones of the present invention, which will be described subsequently in greater detail, is to provide a allows a plurality of users to acquire the same audio output signal from a single audio output means in such a manner as to allow each individual user to control the volume and balance of his or her individually acquired audio signal which has many of the advantages of the audio headphones mentioned heretofore and many novel features that result in a new modularly expandible, multi-user audio headphone which is not anticipated, rendered obvious, suggested, or even implied by any of the prior art audio headphones, either alone or in any combination thereof.

To attain this, the present invention generally comprises an audio headphone having a pair of earpiece speakers affixed to an adjustable leaf spring such as to allow the headphone to affix to a user's head in such a manner as to align the speakers with the user's ears. The speakers are in electrical communication with a stereo, CD player, MP-3 player, or the like by a communication cable that terminates in a modular interconnection housing. The modular interconnection housing has a male communication connector protruding from one end, and a female communication connector received at the opposite end. The male communication connector is designed to provide electrical communication with the audio signal, and the female communication connector is designed to provide parallel electrical communication with the male communication connector. In this manner, more than one user can obtain the same audio output signal. Having its own ability to control volume, balance, or audio signal functions, a plurality of users can acquire and enjoy the same audio output signal from a single device.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. In addition, it is to be understood that the phraseology and terminology employed herein are for the modularly expandable, multi-user audio headphones of description and should not be regarded as limiting.

As such, those skilled in the art will appreciate that the conception, upon which this disclosure is based, may readily be utilized as a basis for the designing of other structures, methods and systems for carrying out the several modularly expandable, multi-user audio headphones of the present invention. It is important, therefore, that the claims be regarded as including such equivalent constructions insofar as they do not depart from the spirit and scope of the present invention.

Further, the modularly expandable, multi-user audio headphones of the foregoing abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new modularly expandible, multi-user audio headphone apparatus and method which has many of the advantages of the audio headphones mentioned heretofore and many novel features that result in a new modularly expandible, multi-user audio headphone which is not anticipated, rendered obvious, suggested, or even implied by any of the prior art audio headphones, either alone or in any combination thereof.

It is another object of the present invention to provide a new modularly expandible, multi-user audio headphone which may be easily and efficiently manufactured and marketed.

It is a further object of the present invention to provide a new modularly expandible, multi-user audio headphone which is of a durable and reliable construction.

An even further object of the present invention is to provide a new modularly expandible, multi-user audio headphone which is susceptible of a low cost of manufacture with regard to both materials and labor, and which accordingly is then susceptible of low prices of sale to the consuming public, thereby making such modularly expandible, multi-user audio headphone economically available to the buying public.

Still yet another object of the present invention is to provide a new modularly expandible, multi-user audio headphone which provides in the apparatuses and methods of the prior art some of the advantages thereof, while simultaneously overcoming some of the disadvantages normally associated therewith.

Still another object of the present invention is to provide a new modularly expandible, multi-user audio headphone for allowing a plurality of users to acquire the same audio output signal from a single audio output means.

Yet another object of the present invention is to provide a new modularly expandible, multi-user audio headphone which includes a plurality of users to acquire the same audio output signal from a single audio output means in a manner such that each individual user can control the volume, balance, and other audio controls of his or her own audio signal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
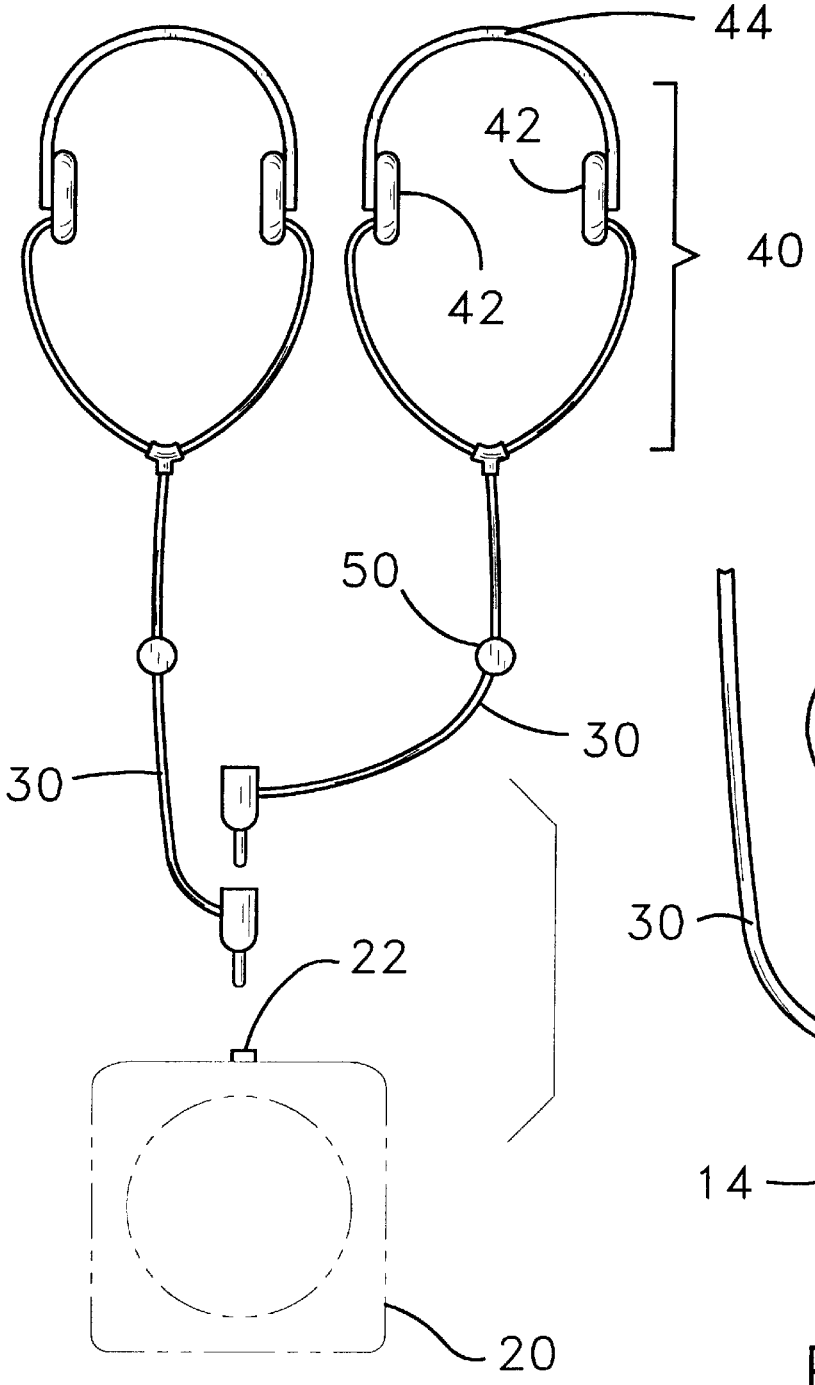
FIG. 1 is a front elevational view of a new modularly expandible, multi-user audio headphone according to the present invention.
Figure 2:
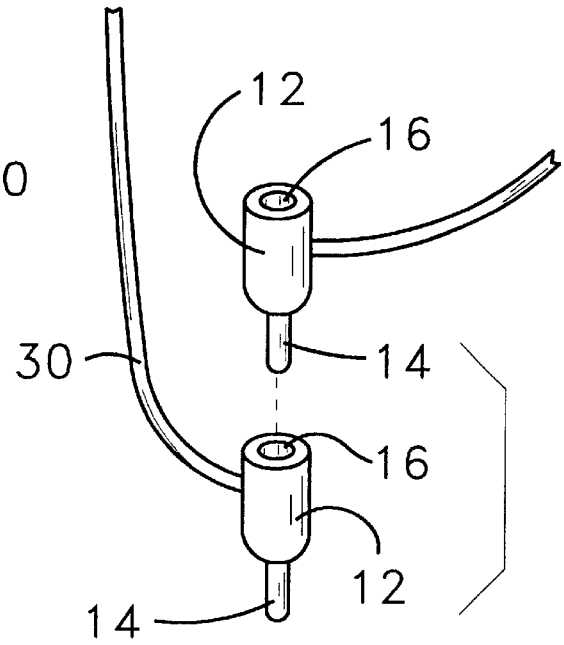
FIG. 2 is a exploded perspective view of the present invention.
Figure 3:
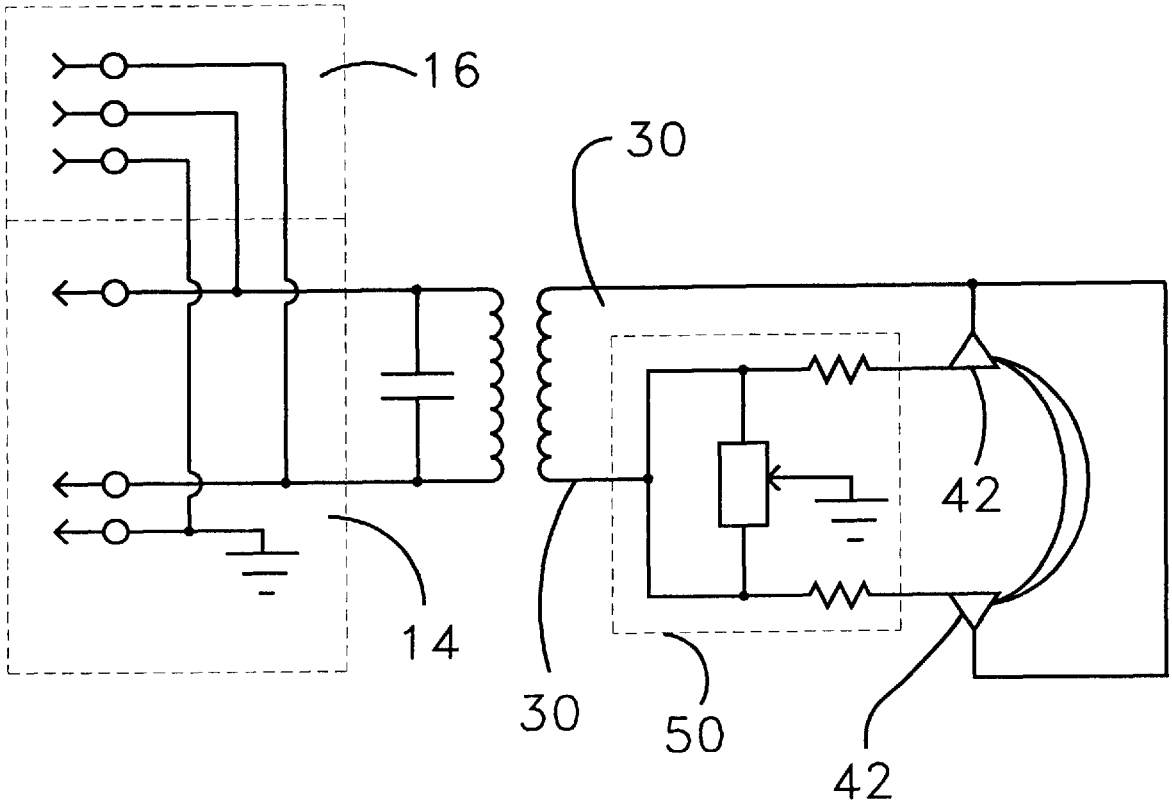
FIG. 3 is an electrical schematic of the present invention.

With reference now to the drawings, and in particular to FIGS. 1 through 3 thereof, a new modularly expandible, multi-user audio headphone embodying the principles and concepts of the present invention and generally designated by the reference numeral 10 will be described.

As best illustrated in FIGS. 1 through 2, a pair of modularly expandible, multi-user audio headphones 10 are shown, each generally comprises modular interconnection housing 12 formed in a generally cylindrical manner and having a top end opposite a bottom end. Protruding from the bottom end is a male communication connector 14. Although the advantages and benefits of the present invention can be achieved in conjunction with the use of any conventional type of electrical communication connector, by way of example, and not by limitation, shown herein is the use of a male communication connector 14. Suitably, the male communication connector may be formed similar to a ⅛ inch (or even a ¼ inch) male headphone plug known to those skilled in the art. Formed integrally within the housing 12 and extending inward from the top end is a female communication connector 16. Although the advantages and benefits of the present invention can be achieved in conjunction with the use of any conventional type of electrical communication connector, it is envisioned that the female communication connector 16 is designed and adapted to provide both firm mechanical contact to and integral electrical communication with a second male communication connector 14 from a second such audio headphone 10. The male communication connector 14 is designed to provide electrical communication with the audio signal from an audio signal output means 20, anticipated as being any conventional, generally available audio appliance such as a stereo, radio, cassette tape player, MP-3 player, or the like having an audio signal output means connector 22, shown herein by way of example as a ⅛ inch (or even ¼ inch) female headphone jack connector. The female communication connector 16 is designed to provide parallel electrical communication with the male communication connector 14. In this manner, more than one user can obtain the same audio output signal.

Further, the male communication connector 14 is in electrical communication with, and provides an electrical audio signal to a communication cable 30. The communication cable 30, in turn, is in electrical communication with, and provides an electrical audio signal to an audio headphone means 40. Although the advantages and benefits of the present invention can be provided in conjunction with any conventionally available audio headphone means, for purposes of describing a best mode, and not by way of limitation, shown herein as an audio headphone means 40 is an audio headphone having a pair of earpiece speakers 42 affixed to an adjustable leaf spring 44 such as to allow the headphone 40 to affix to a user's head (not shown) in such a manner as to align the speakers 42 with the user's ears. The speakers 42 are thereby in electrical communication with the communication cable 30.

Additionally, within the communication cable 30 is optionally an audio control means 50 for controlling the transmission characteristics of the audio signal transmitted through the cable 30. In this respect, it is envisioned that the audio control means 50 could provide the ability to control volume, balance, or audio signal functions of the electrical audio signal transmitted between the audio signal output means 20 and the audio headphone means 40.

In use, male communication connector is designed to provide electrical communication with the audio signal, and the female communication connector is designed to provide parallel electrical communication with the male communication connector. In this manner, more than one user can obtain the same audio output signal. Having its own ability to control volume, balance, or audio signal functions, a plurality of users can acquire and enjoy the same audio output signal from a single device.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A modularly expandible, multi-user audio headphone system comprising:

audio headphone means;

a modular interconnection housing formed in a generally cylindrical manner and having a top end opposite a bottom end;

a male communication connector protruding from said bottom end;

a female communication connector formed integrally within said housing and extending inward from said top end;

a communication cable for providing an electrical audio signal from said modular interconnection housing to said audio headphone means;

wherein said male communication connector is adapted for providing electrical communication of the audio signal from an audio signal output means to the audio headphone means;

wherein said female communication connector is in parallel electrical communication with said male communication connector whereby said female communication connector is adapted for providing the audio signal to one of a plurality of said audio headphone means; and wherein each male communication connector being insertable into said female communication connector for coupling said plurality of audio headphone means in series for providing the audio signal to each of the plurality of headphones.

2. The modularly expandible, multi-user audio headphone system of claim 1, wherein said male communication connector is a headphone plug.

3. The modularly expandible, multi-user audio headphone system of claim 1, wherein said audio headphone means comprises at least one earpiece speakers in electrical communication with said communication cable.

4. The modularly expandible, multi-user audio headphone system of claim 1, further comprising:

audio control means for controlling the transmission characteristics of an audio signal transmitted through said cable.

5. A modularly expandible, multi-user audio headphone system comprising:

audio headphone means;

a modular interconnection housing formed in a generally cylindrical manner and having a top end opposite a bottom end;

a male communication connector protruding from said bottom end;

a female communication connector formed integrally within said housing and extending inward from said top end;

a communication cable for providing an electrical audio signal from said modular interconnection housing to said audio headphone means;

wherein said male communication connector is adapted for providing electrical communication of the audio signal from an audio signal output means to the audio headphone means;

wherein said female communication connector is in parallel electrical communication with said male communication connector whereby said female communication connector is adapted for providing the audio signal to one of a plurality of said audio headphone means;

wherein each male communication connector being insertable into said female communication connector for coupling said plurality of audio headphone means in series for providing the audio signal to each of the plurality of headphones;

wherein said male communication connector is a headphone plug;

wherein said audio headphone means comprises at least one earpiece speakers in electrical commu with said communication cable; and audio control means for controlling the transmission characteristics of an audio signal transmitted through said cable.

* * * * *